US005937757A

United States Patent [19]

Jackson et al.

[11] Patent Number: 5,937,757

[45] Date of Patent: Aug. 17, 1999

[54] GAP ADJUSTING DEVICE WITH PRESSURE RELIEF FOR A SECOND FOLD ROLLER

[75] Inventors: John C. Jackson, Longridge Preston, United Kingdom; Stanley Momot, Indiana Head Park, Ill.

[73] Assignee: Goss Graphic Systems, Inc., Westmont, Ill.

[21] Appl. No.: 09/003,964

[22] Filed: Jan. 7, 1998

[51] Int. Cl.[6] ..... B41F 5/02; B41F 13/56; B31B 1/56

[52] U.S. Cl. ..... 101/232; 270/20.1; 270/41; 493/454; 493/442

[58] Field of Search ..... 101/232, 219; 270/20.1, 41, 45, 21.1; 493/454, 456, 442, 443, 444, 446, 476, 420, 421

[56] References Cited

U.S. PATENT DOCUMENTS

| | | | |
|---|---|---|---|
| 500,433 | 3/1893 | Prum et al. | 270/21.1 |
| 1,937,453 | 11/1933 | Wood . | |
| 1,985,917 | 1/1935 | Crafts . | |
| 3,954,258 | 5/1976 | Skipor et al. . | |
| 4,513,956 | 4/1985 | Sigvardt et al. . | |
| 4,875,668 | 10/1989 | Spyra | 270/45 |
| 4,898,373 | 2/1990 | Newsome | 270/52.29 |
| 5,080,339 | 1/1992 | Hirahara . | |
| 5,135,465 | 8/1992 | Hirahara . | |
| 5,147,276 | 9/1992 | Stäb . | |
| 5,190,514 | 3/1993 | Gazvanauskas | 493/442 |
| 5,242,364 | 9/1993 | Lehmann | 493/421 |
| 5,287,805 | 2/1994 | Fischer et al. | 101/219 |
| 5,490,666 | 2/1996 | Albert . | |
| 5,551,678 | 9/1996 | Michalik et al. | 270/20.1 |
| 5,562,035 | 10/1996 | Pollich | 101/232 |
| 5,718,661 | 2/1998 | Michalik | 493/476 |
| 5,738,620 | 4/1998 | Ebner et al. | 493/445 |
| 5,779,232 | 7/1998 | Ochsner | 270/45 |
| 5,820,540 | 10/1998 | Bohn et al. | 493/456 |

*Primary Examiner*—Eugene Eickholt
*Attorney, Agent, or Firm*—Marshall, O'Toole, Gerstein, Murray & Borun

[57] ABSTRACT

In order to permit automated setting of operating parameters while also facilitating the removal of paper jams, a device for adjusting the gap size between folding rollers of a rotary press folding machine includes a pair of counter-rotating folding rollers which define a folding nip or gap therebetween. Each folding roller is mounted to one end of a pivoting support arm, and a link arm is slidably and pivotably mounted to the other end. An extensible member connects the link arms to each other, which enables the distance between the rollers to be quickly and easily adjusted. An inflatable bag is disposed between the support arms which forces the rollers towards each other to resist spreading of the rollers when a paper passes through the gap between the rollers. The bag can be quickly deflated from a remote location to allow removal of jammed papers, and can be quickly re-inflated to the desired setting to minimize down time. A control system controlling both the extensible member and the inflatable bag permits rapid adjustment of the folding machine to accommodate changes in paper thickness.

31 Claims, 4 Drawing Sheets

GAP ADJUSTING DEVICE WITH PRESSURE RELIEF FOR A SECOND FOLD ROLLER

FIELD OF THE INVENTION

The present invention relates to a device for adjusting the gap between the rollers of a second fold roller commonly employed on a rotary offset printing press. More specifically, the present invention relates to a gap adjusting device having an inflatable pressure relief bag which permits jammed papers to be quickly and easily removed from the folding rollers.

BACKGROUND OF THE INVENTION

Rotary press folding machines are generally well known in the art of printing. Such folding machines are commonly employed to impart one or more folds on printed materials such as catalogs, brochures, and especially newspapers.

Newspapers are most commonly folded in one of two basic formats. The first format, referred to as "broadsheet", has two folds in each section. The first fold (known as the side fold) runs vertically and extends perpendicular to the masthead, while the second fold (known as the end fold) runs horizontally and folds the already folded section in half. In contrast, the second format, referred to as "tabloid", has only the single side fold. The New York Times, the Washington Post, and the Chicago Tribune are representative examples of "broadsheet" formats, while the New York Daily News, the National Enquirer, and the Chicago Sun-Times are representative examples of "tabloid" formats. Typically, the same machinery, commonly called a second fold roller, is used to form the side fold of a thicker "tabloid" newspaper as well as the second fold or end fold of a "broadsheet" paper.

Second fold rollers are well known in the art. On a conventional second fold roller, a printed newspaper having a continuous web of superimposed printed sheets or pages is cut into sections and routed to a folding drum having a folding blade. The folding blade forces each cut section into a gap between a pair of counter-rotating folding rollers, which pinch the section along the desired fold line as the section is forced through the small gap between the rollers. Ideally, the gap between the rollers is slightly smaller than the thickness of the paper in order to ensure that the fold is formed properly. Typically, the gap is set at a minimum size, and a system of control springs that are set at a desired force level cause the rollers to be biased towards each other, yet permit the folding rollers to separate slightly as the paper passes through the gap. After exiting the rollers the folded paper drops onto an exit conveyor in a manner well known in the art.

The folding process occurs at very high speeds, and thus the size of the gap between the folding rollers, as well as the force exerted by the control springs which urge the folding rollers together, must be precisely controlled in order to achieve fast, consistent folds without jamming. A jam typically occurs when a paper gets stuck in the gap. When this happens, two, three, or more papers become stuck in the gap in rapid succession. The folding rollers must then be separated before the jammed papers can be removed. Thereafter, the folding rollers must be returned to their desired position with the correct gap size and the proper amount of control spring force.

One serious disadvantage of prior art folding machines is that, in the event of a jam, it is very time consuming to separate the rollers, remove the jammed papers, and return the rollers to their desired position with the proper amount of control spring force. Typically, the control spring or springs must be removed or otherwise disengaged before the rollers can be separated, and unfortunately these control springs are relatively inaccessible. After the jam has been cleared, correct gap size between the folding rollers must be restored and the control spring or springs must be re-engaged and re-adjusted to the desired pressure. The entire process is very labor intensive, time consuming, and increases the down time of the printing press which consequently greatly reduces productivity.

Another problem faced by prior art folding machines is that, when the thickness of the papers being folded changes, the machine must be stopped and the gap size between the folding rollers must be adjusted to suit the different paper thickness. This gap adjustment in turn changes the tension of the control springs, and thus it is necessary to re-adjust the relatively inaccessible control springs to the desired force level. Like the jam removal process outlined above, the gap adjustment process is similarly labor intensive, time consuming, and subject to operator error. Accordingly, there exists a need for a gap adjustment device on a second fold roller that is easier to adjust and calibrate and that enables the operator to quickly and easily remove jammed papers and return the rollers to their operative positions with the proper control spring force.

SUMMARY OF THE INVENTION

The present invention uses a system of link arms connected to an extensible adjustment member in order to set the minimum gap distance between the folding rollers, and an inflatable bag between the roller support arms to provide a controlled level of biasing force to urge the folding rollers together. When the paper passes through the folding rollers, the rollers are forced apart against the controlled biasing force supplied by the inflatable control bag. The bottom end of each roller support arm is provided with a collar to slidably connect the support arms to the link arms, which permits the rollers to yield slightly when a paper is passed through the rollers. A stop member on each link arm prevents the folding rollers from closing beyond a preset minimum distance.

When a jam occurs, the control bag is quickly and easily deflated and the roller arm collars simply slide along their respective link arms as the folding rollers are moved apart. After the jam is removed, the control bag is re-inflated to the desired pressure which in turn provides the desired level of force on the rollers. In the process, the roller arm collars simply slide back along the link arms until the collars again contact the stop member, and thus the machine is automatically returned to the proper operating position with the desired gap size and the desired control force level.

The adjustment member is preferably a rotatable threaded which is engaged by a trunnion attached to each of the link arms, and thus the desired minimum gap distance between the rollers can be adjusted quickly and accurately. Upon rotation in one direction the adjustment member moves the link arm ends apart to increase the gap distance. Upon rotation in the other direction, the adjustment member moves the link arm ends together to decrease the gap distance. When inflated, the control bag maintains the roller arm collars in abutment with the link arm stop members, which thus define the minimum gap distance.

In order to change the desired gap distance, the extensible member is either lengthened or shortened, which produces a corresponding movement of the link arm stop members. A corresponding change in control force is then effectuated simply by increasing or decreasing the air pressure in the inflatable bag. Preferably, the present invention also includes an integrated control system which automatically adjusts the length of the extensible member in order to set the desired gap distance, and which adjusts the control bag pressure to conform to a predetermined force level. The control system also returns the links and the rollers to their operative positions after a jam has been cleared, and re-inflates the control bag to the desired pressure setting.

Thus, it is an object of this invention is to provide an improved gap adjusting device for a rotary press folding machine.

It is another object of this invention to provide a rotary press folding machine having an inflatable control bag.

A still further object of the invention is to provide a rotary press folding machine having an integrated control system.

These and other objects of the invention will become readily apparent to those skilled in the art upon a reading of the following description.

DETAILED DESCRIPTION OF THE PREFERRED EMBODIMENT

The embodiment described herein is not intended to be exhaustive or to limit the scope of the invention to the precise form disclosed. The following embodiment has been chosen and described in order to best explain the principles of the invention and to enable others skilled in the art to follow its teachings.

Figure 1:
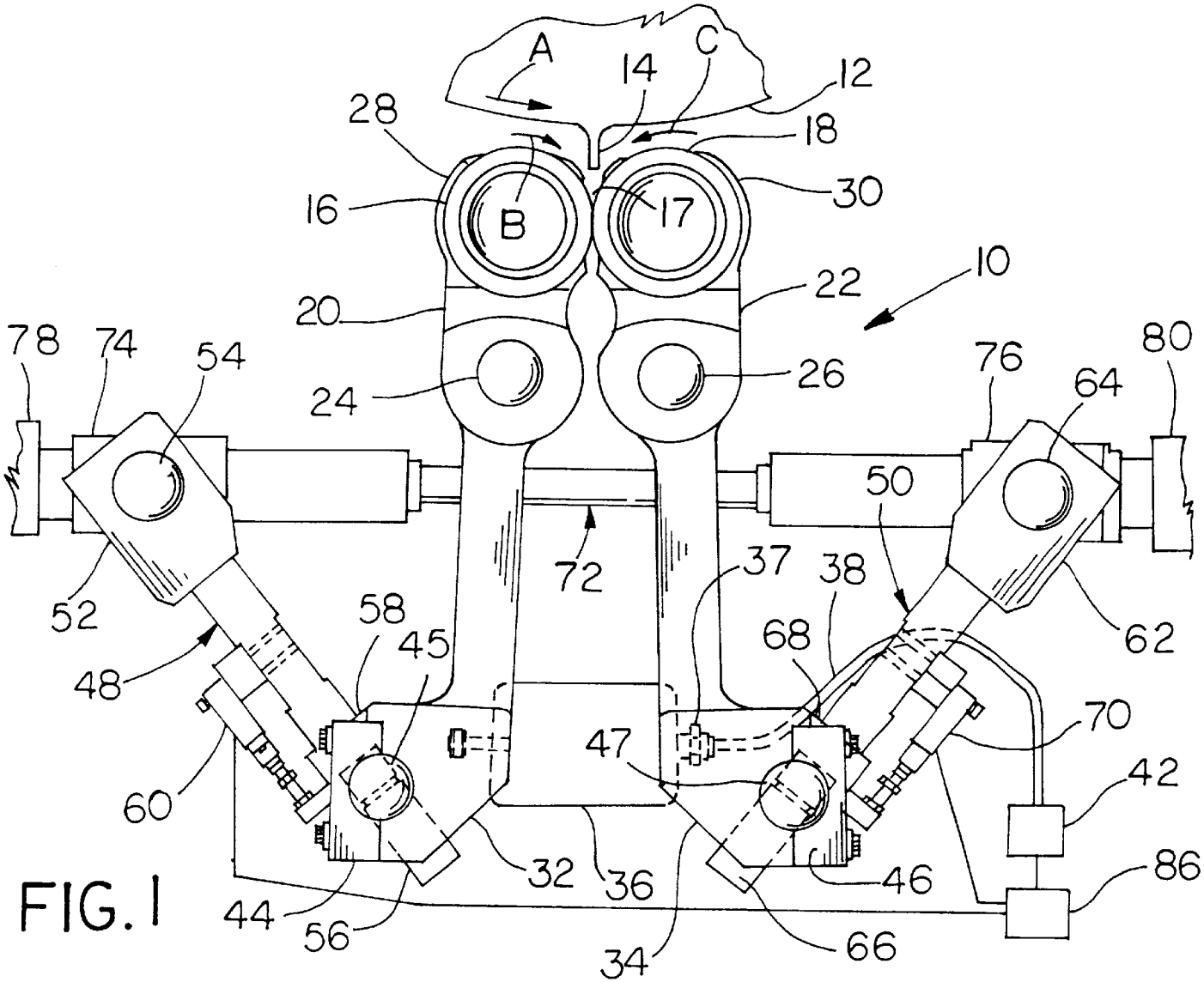
FIG. 1 is an elevational view, partly in section, of a second fold roller machine incorporating the features of the present invention.

Referring now to the drawings, FIG. 1 shows a rotary press folding machine assembled according to the teachings of the present invention which is generally referred to by the reference numeral 10. Machine 10 typically includes a rotary drum 12 having a folding blade 14 which forces or throws a section of newspaper to be folded (not shown) between a pair of counter rotating folding rollers 16, 18 in a manner commonly known in the industry. Rotary drum 12 and folding rollers 16, 18 are rotated at a predetermined speed by a drive system (not shown) as is well known in the art. A nip or gap 17 is defined between folding rollers 16, 18. Each of folding rollers 16, 18 is mounted on a support arm 20, 22, each of which is rotatable about a fixed shaft 24, 26, respectively. Each support arm 20, 22 also includes a roller support end 28, 30 for supporting the adjacent folding rollers 16, 18 respectively, and further includes a lower or adjustment end 32, 34. Each of roller support arms 20, 22 are pivotable about their shafts 24, 26, which varies the distance between folding rollers 16, 18 thus permitting the size of gap 17 to be varied. It will be understood that each folding roller 16, 18 is typically supported by a pair of support arms. However, only a single support arm for each roller is shown in the Figures for the sake of simplicity.

An inflatable pneumatic control bag 36 is disposed between the lower end 32, 34 of the support arms 20, 22. Control bag 36 is connected to an air supply hose 38 which communicates air from a supply compressor (not shown). Control bag 36 and supply hose 38 are connected using commercially available fittings in a manner commonly known in the art. Air supply hose 38 is connected to a pressure regulator 42. Preferably, control bag 36 includes a relief valve 37, which is operatively connected to pressure regulator 42, which thus enables control bag 36 to be remotely deflated.

The lower ends 32, 34 of each support arm 20, 22 are slidably and pivotably connected by a collar 44, 46 to a link arm 48, 50 respectively. Collars 44, 46 each include a pivot 45, 47, respectively, which permits link arms 48, 50 to pivot relative to the their respective support arms 20, 22. Link arm 48 includes an upper end 52 having a pivot 54 and a lower shaft 56 terminating at annular collar or stop member 58. Collar 44 is slidable along shaft 56, with stop member 58 defining the upper limit of travel. Link arm 48 also includes a limit switch assembly 60.

Similarly, link arm 50 includes an upper end 62 having a pivot 64 and a lower shaft 66 terminating at annular collar or stop member 68. Collar 46 is slidable along shaft 66, with stop member 68 defining the upper limit of travel. Link arm 50 also includes a limit switch 70, which along with the limit switch assembly 60 carried by link arm 48 senses the force being applied between the rollers 16, 18. Each of limit switch assemblies 60, 70 are connected to a master controller 86, which is discussed in further detail below.

Figure 2:
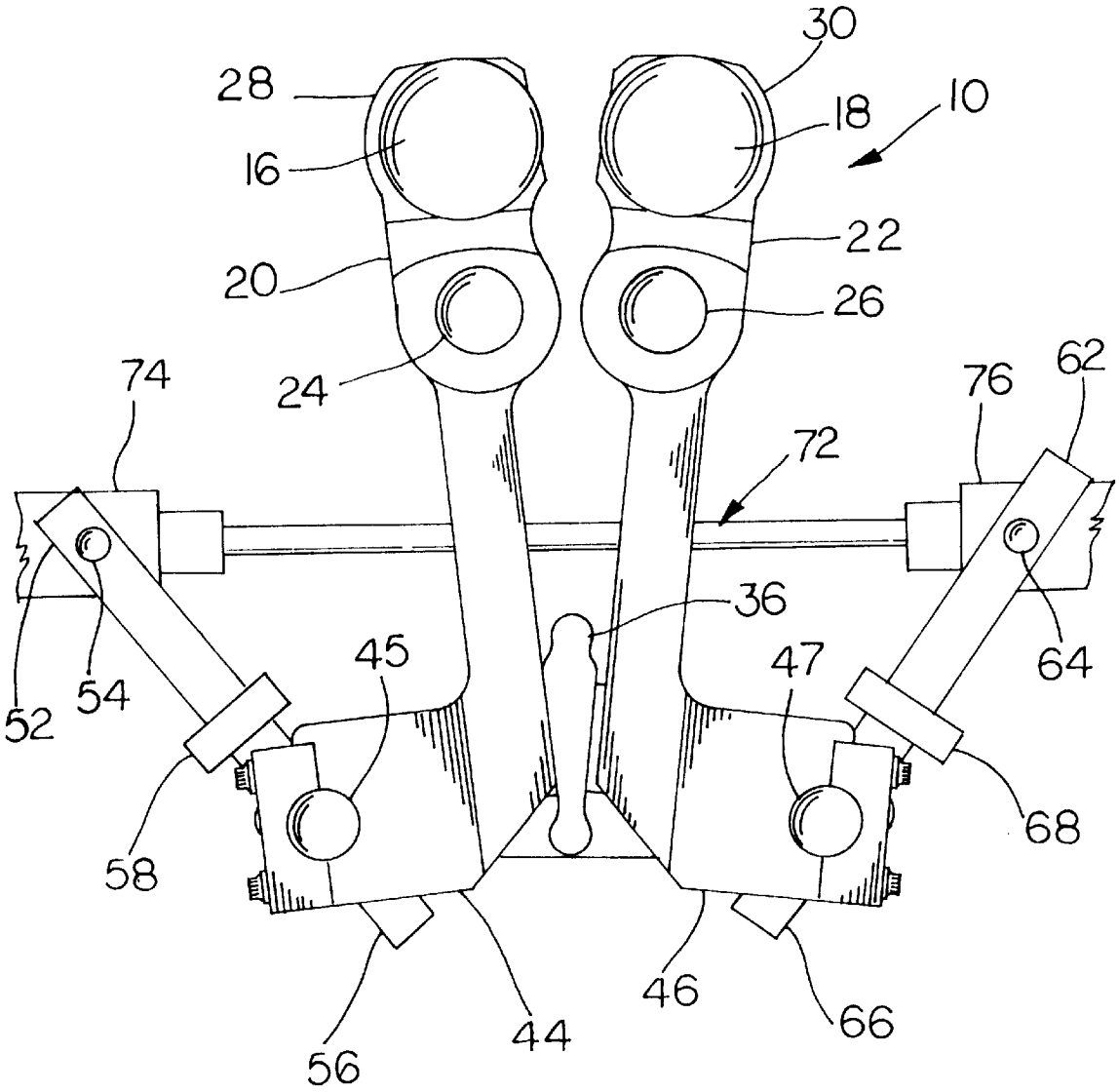
FIG. 2 is a fragmentary schematic elevational view of the second fold roller machine shown in FIG. 1 but showing the pneumatic bag deflated to allow the folding rollers to be separated from each other with the lower ends of the roller support arms being shown shifted relative to the links away from the stop members.
Figure 3:
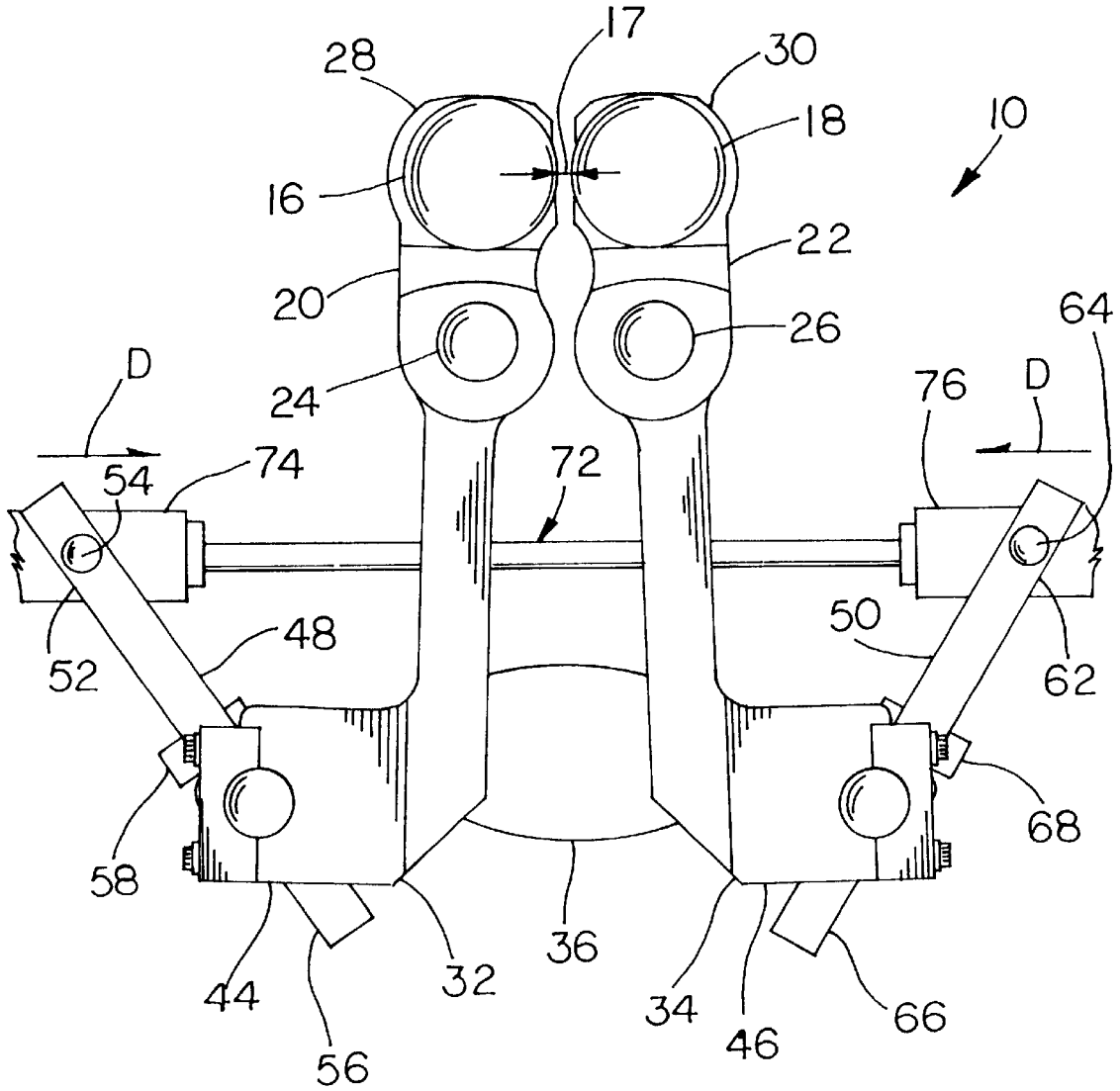
FIG. 3 is a fragmentary elevational view similar to FIGS. 1 and 2 but showing the extensible adjustment member in a shortened position in order to provide a larger minimum gap size between the folding rollers.

When inflated, control bag 36 forces collars 44, 46 into contact with their adjacent stop members 58, 68 as shown in FIGS. 1 and 3. When control bag 36 is deflated as shown in FIG. 2, collars 44, 46 are free to slide relative to their respective shafts 56, 66 and away from the stop members 58, 68 as the folding rollers 16, 18 are moved apart. As discussed in greater detail below, the location of the stop members 58, 68 can be varied, which thus allows the operator to set the minimum desired size of gap 17.

Figure 4:
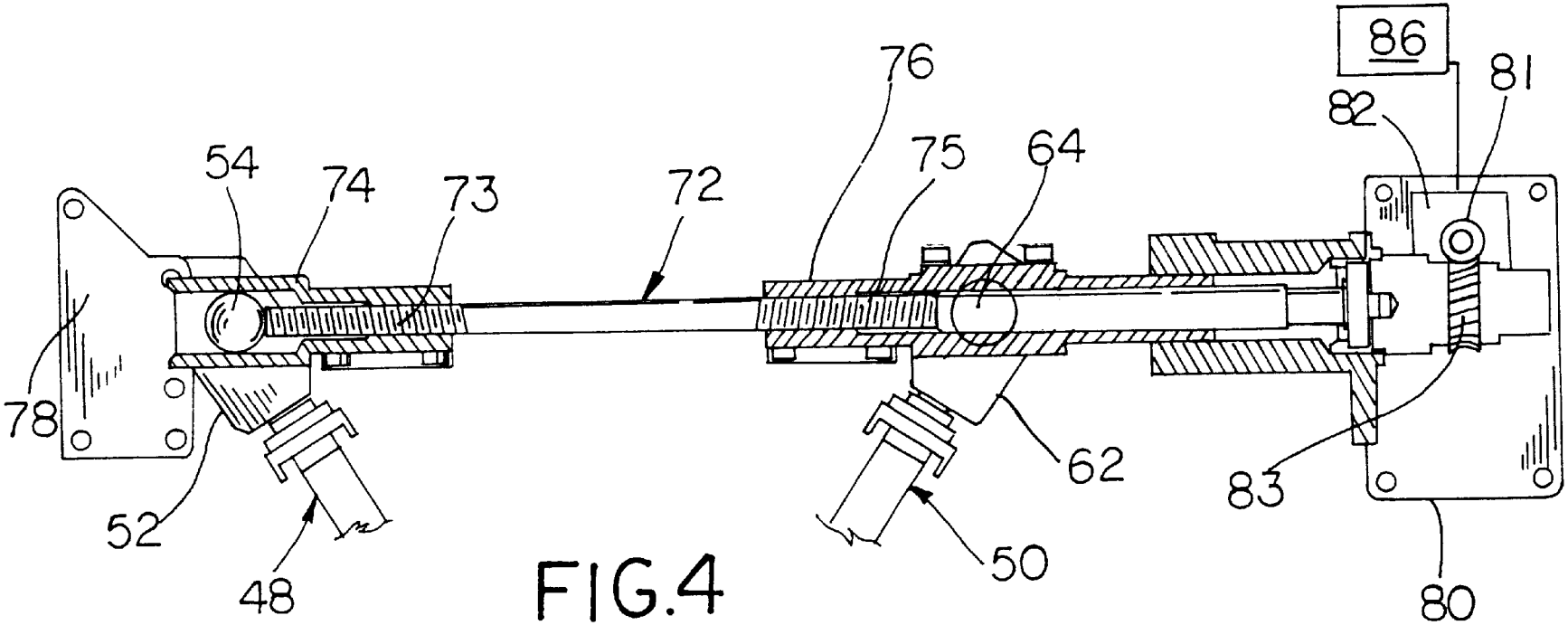
FIG. 4 is a fragmentary elevational view of the extensible adjustment member illustrating the threaded rod and the thread followers which pivotally connect the link arms to the threaded rod.

Ends 52, 62 of link arms 48, 50 are connected by a threaded member 72, which is used to vary the position of link arms 48, 50. As shown to advantage in FIG. 4, threaded member 72 includes a pair of oppositely pitched threaded portions 73, 75. Ends 52, 62 of link arms 48, 50 are pivotably mounted to threaded followers 74, 76 by virtue of pivots 54, 64. Thus, link arms 48, 50 are free to pivot relative to the threaded member 72. Accordingly, ends 52, 62 are shiftable back and forth along a generally horizontal path upon rotation of threaded member 72 by virtue of the opposite threading of threaded portions 73, 75. Threaded member 72 is mounted for rotation between a pair of fixed supports 78, 80 in a conventional manner, and includes a worm gear 81 engaging a ring gear 83 for rotating the threaded member 72. Wrom gear 81 is operably connected to a drive motor 82. Drive motor 82 in turn is operatively connected to the master controller 86, which allows the operator to set the position of ends 52, 62 relative to each other (e.g. closer together or farther apart). The master controller 86 is also operatively connected to the pressure regulator 42 of control bag 36 and to the limit switches 60, 70.

In operation, rotary drum 12 and folding rollers 16, 18 rotate in the directions indicated by reference arrows A, B and C, respectively, in FIG. 1, ideally at the same peripheral speed. The folding rollers 16, 18 and the rotary drum are rotated by a common drive system as is well known in the art. A newspaper to be folded (not shown) consisting of a number of paper sheets is routed along drum 12 and forced into the gap 17 between the folding rollers 16, 18 by folding blade 14, thus folding the paper sheets in a manner commonly employed in the industry. The desired minimum size of gap 17 depends on the thickness of the paper to be folded, as well as the type of paper being folded. Ideally, the size of gap 17 is slightly smaller than the thickness of the paper. The control bag 36 is inflated to a desired level so that the requisite level of force is exerted on the paper as it passes through the folding rollers 16, 18 thus imparting a high quality fold. The collars 44, 46 abut their respective stop members 58, 68, which cooperate to define the desired minimum size of gap 17.

Of course, the desired minimum size of gap 17 varies as the thickness of the paper to be folded changes. In other words, a thicker paper will have a larger minimum size for gap 17, while a thinner paper will require a smaller minimum size for gap 17. The desired minimum size of gap 17 is set using threaded member 72 to change the distance between thread followers 74, 76 and hence the distance between ends 52 and 62 of the link arms. The pressure in control bag 36 urges the collars 44, 46 into contact with the stop members 58, 68 by forcing ends 32, 34 of support arms 20, 22 apart. When the link arms 48, 50 are moved, the locations of the stop members 58, 68 also move which alters the size of the gap 17. The air in control bag 36 again maintains the collars 44, 46 in abutment with their respective stop members 58, 68, and the pressure in control bag 36 is adjusted accordingly in order to maintain the desired level of force on the paper by urging the folding rollers 16, 18 together. For example, the force exerted by the folding rollers 16, 18 against the paper can be easily calculated using known engineering principles by taking into account the length of the support arms 20, 22, the mechanical advantage provided by the location of the shafts 24, 26, the pressure in the control bag 36, the surface area of the folding rollers 16, 18 in contact with the paper, as well as the surface area of the control bag 36 in contact with the adjustment ends 32, 34.

The adjustment of the size of gap 17 is illustrated in FIG. 3. As shown, the size of the gap 17 has been increased by using the threaded member 72 to draw ends 52, 62 of the link arms closer together in the direction indicated by reference arrows D. The bag 36 is compressed slightly (with the air pressure being adjusted accordingly) and stop members 58, 68 act against the collars 44, 46 to bring ends 32, 34 closer together. In turn, folding rollers 16, 18 are moved apart, thereby increasing the size of gap 17. The process is simply reversed in order to decrease the size of gap 17.

Preferably, the position of the stop members 58, 68, and hence the minimum gap size, is set using the master controller 86, which positions all of the components according to parameters input by the operator, such as the paper thickness, the desired force level applied against the paper, etc. The master controller 86 positions the components at the necessary locations and sets the pressure in control bag 36 via pressure regulator 42. Master controller 86 permits fast adjustment of the components and fast changes of the pressure in control bag 36, and thus when the thickness of the paper is changed, the machine 10 can be adjusted very swiftly.

When the paper passes through the gap 17 between folding rollers 16, 18 the folding rollers 16, 18 are forced apart slightly, with the control bag 36 offering a certain level of resilient biasing resistance. The support arms 20, 22 rotate about their respective shafts 24, 26, and the gap 17 is slightly widened. In the process, the collars 44, 46 slide a slight distance along their respective shafts 56, 66 of link arms 48, 50 away from the stop members 58, 68. The pressure in control bag 36 maintains the desired level of force on the paper by urging the rollers 16, 18 together thus preventing the folding rollers 16, 18 from moving too far apart.

In the event of a jam, a number of consecutive sections of papers may become stuck between the folding rollers 16, 18. As the jam accumulates, the rollers 16, 18 are forced apart such that the collars 44, 46 move away from their adjacent stop members 58, 68. The control bag 36 ensures that constant pressure is applied rather than increasing pressure as would be the case with the conventional spring loaded assembly. When this occurs, the control bag 36 is quickly deflated using the master controller 86 to control the relief valve 37 through the pressure regulator 42, and thus the support arms 20, 22 are free to rotate about their respective shafts 24, 26 so that the folding rollers 16, 18 can be separated. The gap 17 is thus greatly widened as shown in FIG. 2, so that the space between the folding rollers 16, 18 is easily accessible to the operator. Once the jammed papers have been removed, the master controller 86 re-inflates the control bag 36 to the desired pressure level, and the collars 44, 46 slide back up along their respective shafts 56, 66 until the collars 44, 46 are again in contact with their adjacent stop members 58, 68, respectively. As the support arms 20, 22 rotate, the folding rollers 16, 18 are returned to their desired positions. Because the ends 52, 62 of the link arms 48, 50 have not been moved, the desired minimum size of gap 17 remains unchanged, and the master controller 86 via pressure regulator 42 automatically returns the pressure in control bag 36 to the necessary level. Accordingly, the process of clearing jammed papers is greatly expedited.

It will be understood that the above description does not limit the invention to the above-given details. It is contemplated that various modifications and substitutions can be made without departing from the spirit and scope of the following claims.

What is claimed:

1. A gap adjusting device for a rotary press folding machine having a pair of folding rollers, the rollers defining a folding gap therebetween, said device comprising:

a pair of roller support arms, each of said support arms having a central pivot, a roller end supporting the adjacent roller, and an adjustment end opposite said roller end;

a pair of links, each of said links having a first end slidably engaging an adjacent one of said support arm adjustment ends and further having a second end remote therefrom, each of said link first ends further being pivotable relative to its said adjacent support arm;

an extensible member connecting each of said link second ends to each other for varying the distance between said link second ends to thereby change the minimum size of the gap, each of said link second ends further being pivotable relative to said extensible member; and an inflatable bag disposed between said arm adjustment ends for forcing the rollers towards each other upon inflation of said bag by spreading said adjustment ends apart, said bag further allowing the rollers to be shifted away from each other upon deflation of said bag thereby increasing the gap to provide access between the rollers.

2. The device as claimed in claim 1, wherein each of said links includes a shaft and each of said adjacent roller arm adjustment ends includes a collar slidably engaging said shaft, said collar permitting said adjustment ends to move relative to said links.

3. The device as claimed in claim 1, wherein each of said links includes a stop member for limiting the sliding movement of said adjacent roller arm adjustment ends relative to said links, said stop members thereby defining a minimum gap size when said bag is inflated by urging said adjustment ends towards contact with their adjacent stop members.

4. The device as claimed in claim 1, wherein said inflatable bag includes a pressure regulator for controlling the pressure in said bag.

5. The device as claimed in claim 1, wherein said inflatable bag includes a relief valve for deflating said bag.

6. The device as claimed in claim 4, including a master controller for controlling said pressure regulator to vary the pressure in said bag to conform to a predetermined level.

7. The device as claimed in claim 1, wherein said extensible member includes a threaded rod.

8. The device as claimed in claim 1, wherein said extensible member includes a variable position controller for controlling the length of said extensible member.

9. The device as claimed in claim 1, including a controller for controlling the length of said extensible member, and wherein said inflatable bag includes a pressure regulator controlled by said master controller for varying the pressure in said bag, said master controller being configured to control the length of said extensible member and the pressure in said bag to conform to predetermined settings.

10. A gap adjusting device for a rotary press folding machine having a pair of rollers, comprising:

a pair of roller arms, each of said roller arms having a central pivot, a roller end supporting the adjacent folding roller, and an adjustment end opposite said roller end;

an extensible member having a pair of ends;

a pair of link arms, each of said link arms connecting one of said roller arm adjustment ends to an adjacent one of said extensible member ends, each of said link arms slidably and pivotably engaging its adjacent one of said roller arm adjustment ends, each of said link arms further being pivotable relative to its adjacent one of said extensible member ends; and an pneumatic bag connected to said roller arm adjustment ends for biasing the rollers towards each other upon inflation and further for allowing the rollers to be shifted away from each other upon deflation.

11. The device as claimed in claim 10, wherein each of said links includes a shaft and each of said adjacent roller arm adjustment ends includes a collar slidably engaging said shaft, said collar permitting said adjustment ends to move relative to said links.

12. The device as claimed in claim 10, wherein each of said links includes a stop member for limiting the sliding movement of its adjacent one of said roller arm adjustment ends relative thereto, said stop members thereby defining a minimum gap size when said bag is inflated by urging said adjustment ends towards contact with said stop members.

13. The device as claimed in claim 10, wherein said pneumatic bag includes a pressure regulator for controlling the pressure in said bag.

14. The device as claimed in claim 10, wherein said pneumatic bag includes a relief valve for rapidly deflating said bag.

15. The device as claimed in claim 13, including a master controller for controlling said pressure regulator to vary the pressure in said bag to conform to a predetermined level.

16. The device as claimed in claim 10, wherein said extensible member includes a threaded rod.

17. The device as claimed in claim 10, wherein said extensible member is connected to a controller for controlling the length of said extensible member.

18. The device as claimed in claim 10, including a controller for controlling the length of said extensible member, and wherein said inflatable bag includes a pressure regulator controlled by said master controller for varying the pressure in said bag, said master controller being configured to control the length of said extensible member and the pressure in said bag to conform to predetermined settings.

19. A gap adjusting device for a rotary press folding machine, comprising:

a pair of roller support arms, each of said support arms having a fixed central pivot, a roller end supporting a folding roller, the folding rollers defining a gap therebetween, each of said support arms further including an adjustment end opposite said roller end;

a pair of links, each of said links having first and second ends, said first end of each of said links being slidably engaged by an adjacent one of said support arm adjustment ends, each of said links further including a stop member;

an inflatable bag engaging said support arm adjustment ends for urging the rollers towards each other upon inflation of said bag; and gap adjustment means operatively connected to said links for varying the distance between the other of said link ends, thereby varying the gap size.

20. The device as claimed in claim 19, wherein each of said links are pivotable relative to its adjacent support arm.

21. The device as claimed in claim 19, wherein said gap adjustment means includes a threaded rod.

22. The device as claimed in claim 21, wherein said link second ends are pivotable relative to said threaded rod.

23. The device as claimed in claim 19, wherein each of said first link ends includes a shaft and each of said support arms includes a collar slidably mounted to its adjacent shaft.

24. The device as claimed in claim 19, wherein each of said links include a stop member for limiting the movement of said adjustment ends along said links, said adjustment ends abutting said stop members upon inflation of said bag thereby defining a minimum gap size between the rollers.

25. The device as claimed in claim 19, wherein said inflatable bag includes a pressure regulator for controlling the pressure in said bag.

26. The device as claimed in claim 19, wherein said inflatable bag includes a relief valve for rapidly deflating said bag.

27. The device as claimed in claim 22, wherein said pressure regulator includes a variable controller for varying the pressure in said bag to conform to a predetermined level.

28. The device as claimed in claim 19, wherein said gap adjustment means includes an extensible member including a threaded rod.

29. The device as claimed in claim 19, wherein said gap adjustment means comprises an extensible member operatively connected to a controller for controlling the length of said extensible member.

30. The device as claimed in claim 19, wherein said gap adjustment means includes an extensible member and further includes a controller for controlling the length of said extensible member, said inflatable bag including a pressure regulator controlled by said controller for varying the pressure in said bag, said controller being configured to control the length of said extensible member and the pressure in said bag to conform to predetermined settings.

31. The device as claimed in claim 19, including stop means for limiting the movement of said adjustment ends relative to said links.

* * * * *